US009259375B2

(12) United States Patent
Miller

(10) Patent No.: US 9,259,375 B2
(45) Date of Patent: Feb. 16, 2016

(54) PRESCRIPTION PILL VIAL WITH RATCHETING DOSAGE INDEXER

(71) Applicant: Mark H. Miller, Ayer, MA (US)

(72) Inventor: Mark H. Miller, Ayer, MA (US)

( * ) Notice: Subject to any disclaimer, the term of this patent is extended or adjusted under 35 U.S.C. 154(b) by 253 days.

(21) Appl. No.: 14/083,717

(22) Filed: Nov. 19, 2013

(65) Prior Publication Data

US 2015/0136641 A1 May 21, 2015

(51) Int. Cl.
*A61J 1/03* (2006.01)

(52) U.S. Cl.
CPC ..... *A61J 1/03* (2013.01); *A61J 2205/30* (2013.01)

(58) Field of Classification Search
CPC ..... A61J 7/02
USPC ..... 116/308–315; 206/459.1
See application file for complete search history.

(56) References Cited

U.S. PATENT DOCUMENTS 4,528,933 A * 7/1985 Allen ..... A61J 7/04 116/308
6,229,431 B1 * 5/2001 Weiner ..... A61J 1/03 340/309.7
7,000,791 B2 2/2006 Miller
9,021,980 B1 * 5/2015 Vasta ..... G09F 11/23 116/308
2001/0040500 A1 * 11/2001 Weiner ..... A61J 7/0481 340/309.7
2004/0144677 A1 * 7/2004 Miller ..... A61J 7/04 206/459.1
2004/0173137 A1 * 9/2004 Carbajal ..... F24F 3/16 116/311
2009/0293798 A1 * 12/2009 Kreshek ..... G09F 11/23 116/308

* cited by examiner

*Primary Examiner* — Daniel S Larkin
*Assistant Examiner* — Irving A Campbell

(57) ABSTRACT

A prescription pill vial with dosage indexer is disclosed. The prescription pill vial includes a body having a sidewall and bottom forming an enclosure for prescription medications. The sidewall extends below the bottom forming a cavity beneath the enclosure. A rosette is on the bottom of the body. The rosette has a plurality of detents thereon. An indexer is configured to fit into the cavity and rotate therewithin. The indexer has a spring-biased pawl that engages the detents on the rosette, limiting the rotation of the indexer to a number of predefined positions corresponding to the detents on the rosette.

20 Claims, 9 Drawing Sheets

PRESCRIPTION PILL VIAL WITH RATCHETING DOSAGE INDEXER

BACKGROUND OF THE INVENTION

1. Field of the Invention

The present patent document relates generally to prescription pill vials and more particularly to a prescription pill vial with a ratcheting dosage indexer incorporated into the bottom of the vial.

2. Background of the Related Art

Prescription pill vials with dosage indexers are useful in order for individuals to remember or be reminded of how many pills they have previously taken that day. Indexers may also be used to track the time of when to take the next pill, or when the last pill was taken. Prior art indexers suffer from the disadvantage of being easily bumped, therefore, causing confusion as to whether a dose was previously taken or not and being difficult to turn. Therefore, there is a perceived need in the industry for a prescription pill vial with an indexer that is easy to turn, yet is not easily dislodged from its current position.

SUMMARY OF THE INVENTION

The prescription pill vial with ratcheting dosage indexer disclosed herein solves the problems of the prior art by providing a ratcheting mechanism on the bottom of the vial and indexer with a pawl and pawl arm that provides a vial that is hermetically sealed and has a smooth and stable movement on the ratcheting indexer that prevents accidental slippage yet is easy to turn and has a positive lock in each indexing position. The prescription pill vial includes a vial having a sidewall and bottom forming an enclosure for prescription medications. The sidewall extends below the bottom forming a cavity beneath the enclosure. The bottom includes a rosette with a number of detent positions, preferably an odd number of positions such as thirteen. The indexed includes a pawl on a resilient pawl arm. The indexer is configured and arranged to snap into the cavity and rotate therewithin, with the pawl engaging a detent position on the rosette and the pawl arm flexing to permit rotation of the indexer within the cavity.

BRIEF DESCRIPTION OF THE DRAWINGS

These and other features, aspects, and advantages of the present invention will become better understood with reference to the following description, appended claims, and accompanying drawings where:

DESCRIPTION OF THE PREFERRED EMBODIMENT

Figure 1:
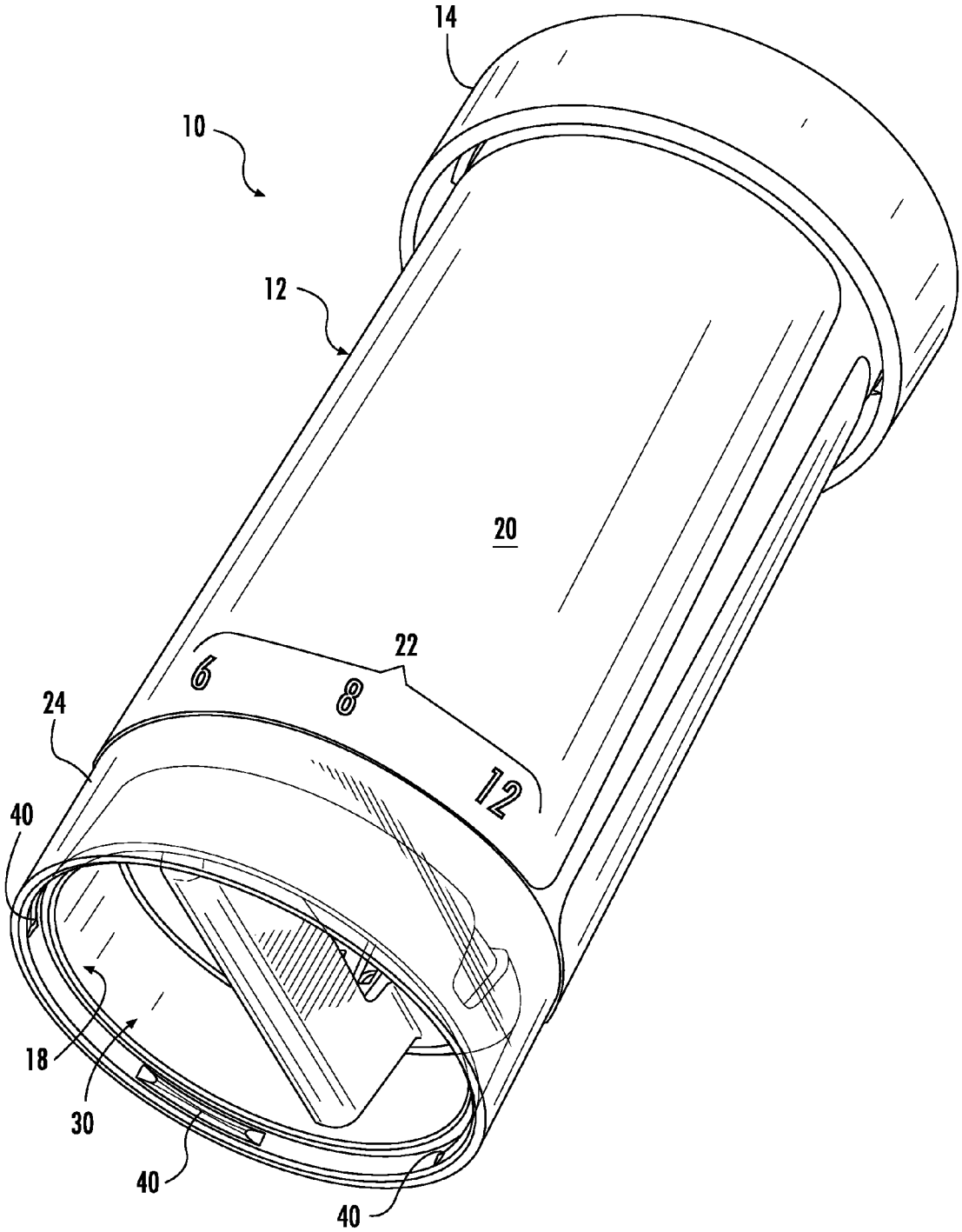
FIG. 1 is a bottom perspective view of the pill vial with ratcheting dosage indexer.
Figure 2:
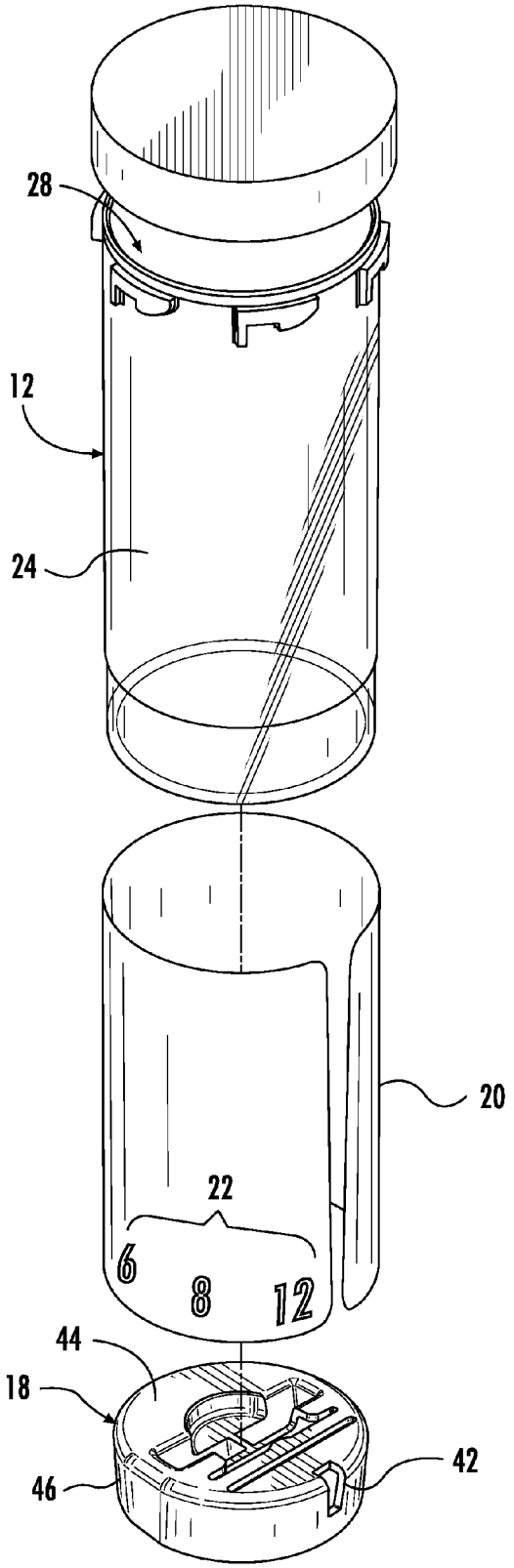
FIG. 2 is an exploded view of the pill vial with ratcheting dosage indexer.

Referring to FIGS. 1 and 2, the pill vial with a ratcheting dosage indexer is shown generally at 10. As will be described in more detail below, the pill vial 10 generally includes a body 12, a closure 14, an indexer 18 and some manner of indicia 20 on the vial, such as a label 22.

The pill vial 10 includes a body 12 having a sidewall 24 and a bottom 26 forming an enclosure 28 for prescription medications. The top of the body 12 is open, but is adapted to receive a water-tight or moisture-resistant closure 14, which may be tamper evident and/or childproof as is known in the art. The sidewall 24 extends below the bottom 26 forming a cavity 30 beneath the enclosure 28. The cavity 30 on the bottom 26 of the body 12 is separate from the enclosure 28.

Indicia 22 indicating the numbers of pills taken per day are printed, embossed, or otherwise formed circumferentially around the sidewall 24 of the body 12. Preferably the indicia 22 are printed on the prescription label 20 that is applied to the sidewall 24 of the body 12. Printing the indicia 22 on the prescription label 20 is more advantageous because a single "stock" vial 10 and indexer 18 may be used to fill all prescriptions, yet each prescription can uniquely convey to the patient the number of dosages prescribed because the dosage information is printed on the prescription label 20 at the time the prescription is filled. The indicia 22 may also be printed on separate labels, apart from the prescription information, that may be applied to the body 12 as well.

Figure 3:
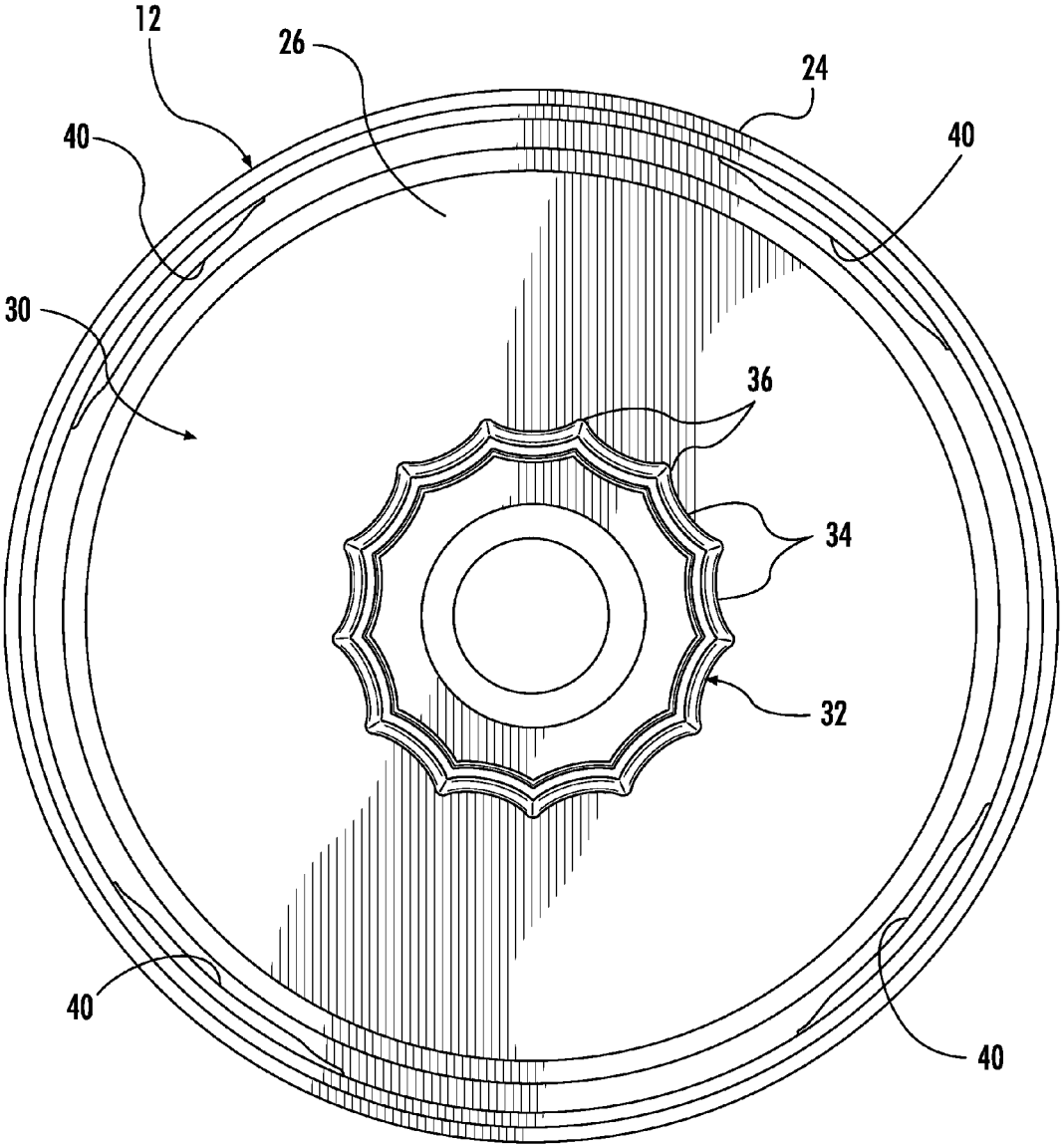
FIG. 3 is a bottom plan view of the pill vial with the ratcheting dosage indexer removed.

Referring to FIG. 3, centered on the bottom 26 of the body 12 is a rosette 32 having a number of detents 34. Thirteen detents 34 are shown in the illustrated embodiment and preferably there are an odd number of positions to provide a zero-point for the indexer 18, but any number of detent positions may be provided as desired. Each detent 34 includes a curved surface, which will be described in greater detail below with reference to FIG. 9 to describe how the prescription pill vial 10 has improved indexer 18 turning action. The tip of each "point" 36 in the rosette 30, where the curved surface of the rosette 30 meets between separate detent 34 positions, includes a rounded surface to ease the pawl's 38 movement into the next detent 34.

The inside portion of the sidewall 24 within the cavity 30 further includes a number of raised shoulders 40 configured to retain the indexer 18 within the cavity 30. The raised shoulders 40 do not interfere with the rotation of the indexer 18 within the cavity 30.

Figure 4:
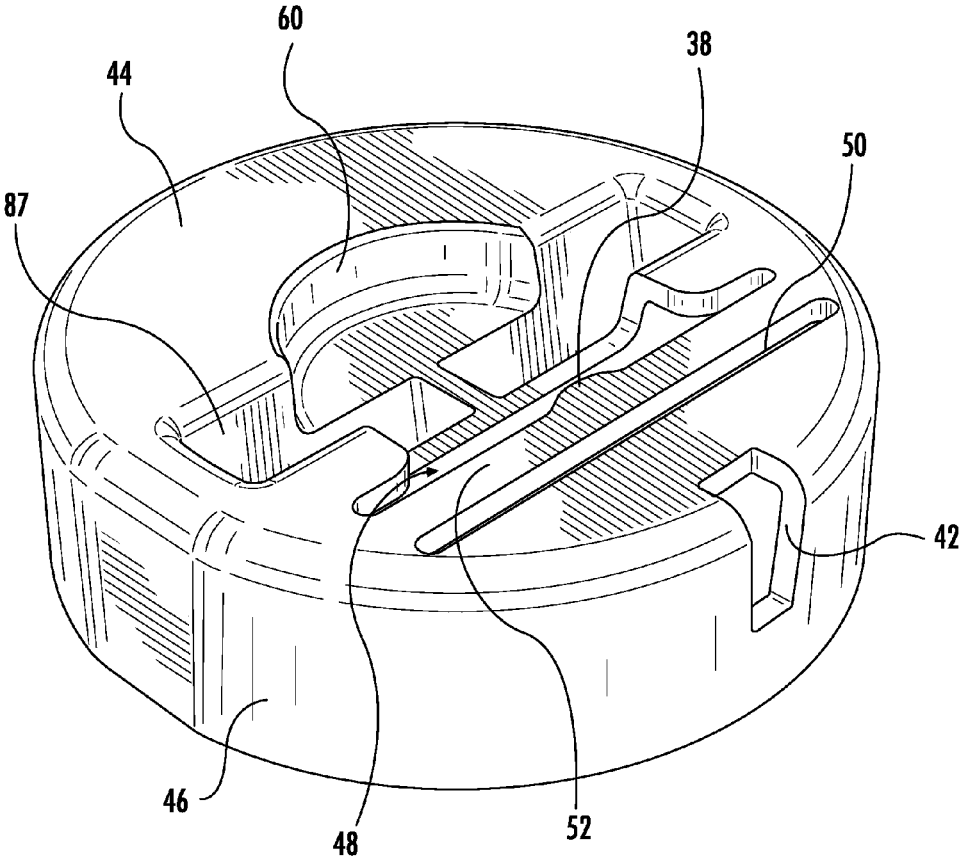
FIG. 4 is a top, perspective view of the indexer.
Figure 5:
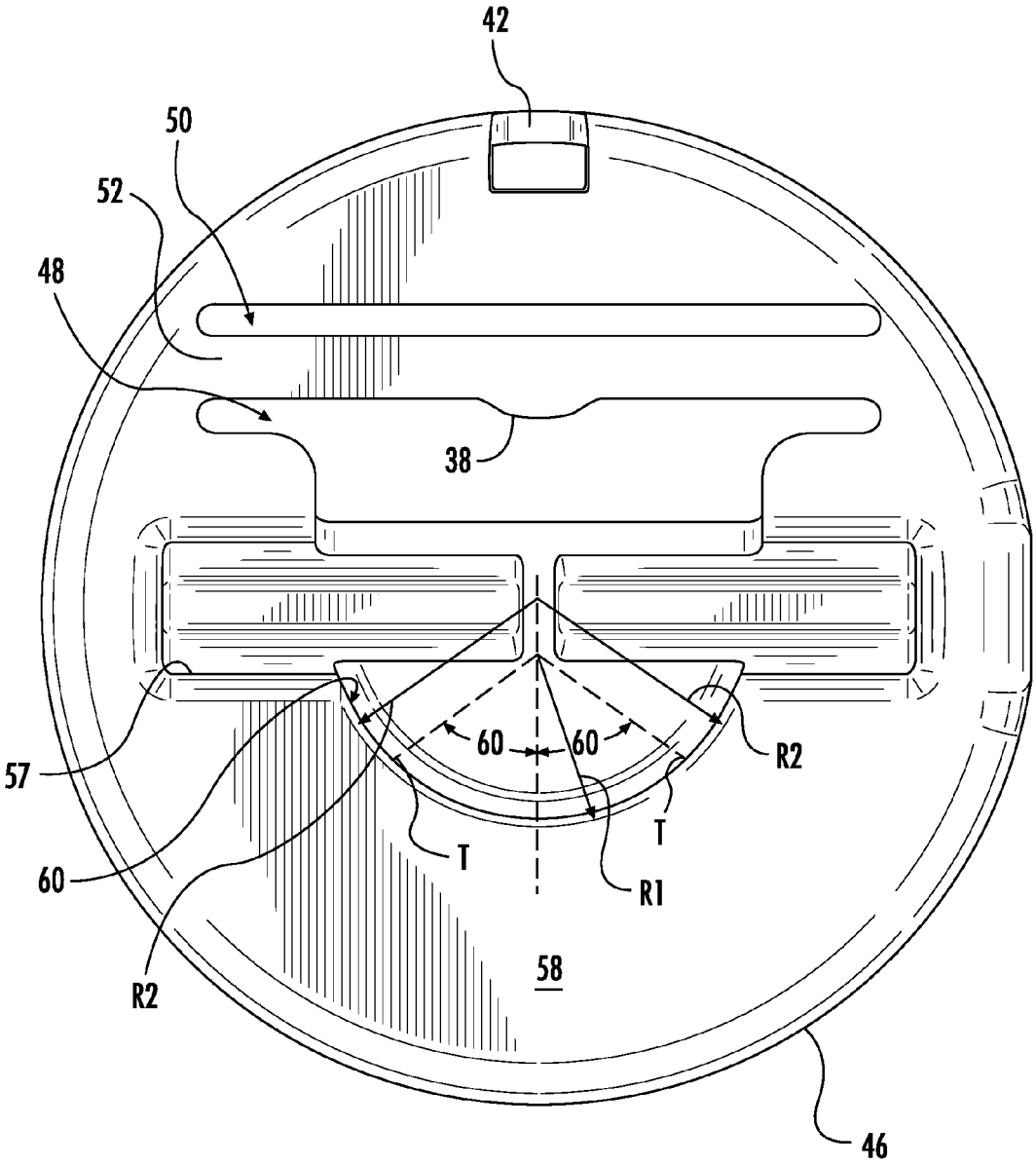
FIG. 5 is a top plan view of the indexer.
Figure 6:
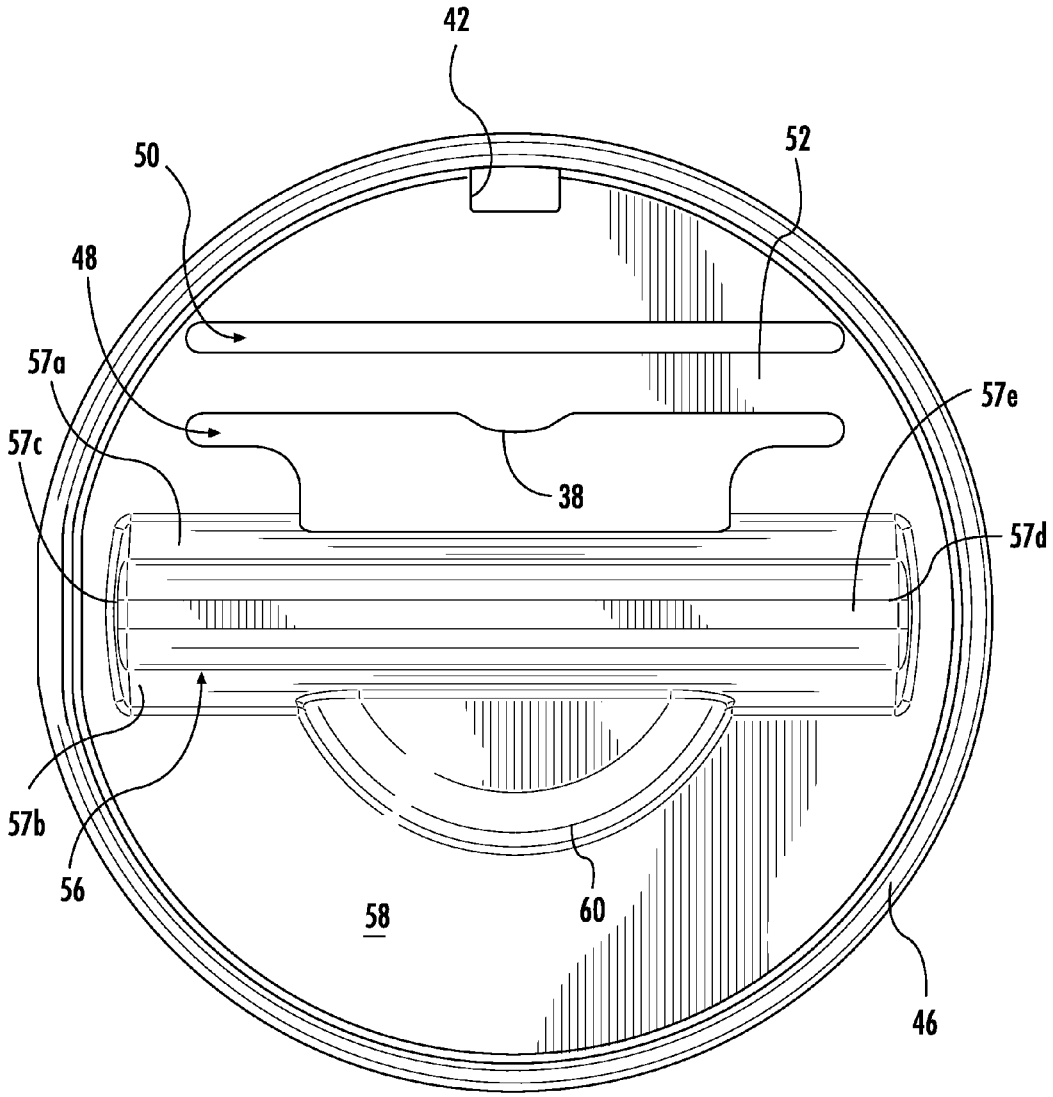
FIG. 6 is a bottom plan view of the indexer.

Referring to FIGS. 4-6 the indexer 18 is configured and arranged to snap into the cavity 30 on the body 12 and rotate therewithin. The indexer 18 is rotatably moveable to any one of thirteen equally-spaced detent positions corresponding to the detents 34 on the rosette 32. The indexer 18 has an index mark 42 such as a visible arrow, pointer, or some other identifying feature molded, printed, or embossed upon it for the purpose of aligning with the indicia 22 which are disposed circumferentially around the lower end of the label 20. In this embodiment, the index mark 42 is illustrated as a window in the indexer 18. Because the sidewall 24 of the body 12 of the prescription pill vial 10 is often manufactured from transparent or translucent plastic, the window 42 is visibly distinct and marks the rotational position of the indexer 18 within the cavity 30.

The indexer 18 includes a circular deck 44 having an outer skirt 46 depending therefrom. As previously mentioned, the index mark 46 is formed as a window through the deck 44 and outer skirt 46, providing a visible contrast through the body 12 of the prescription pill vial 10 to inform the user of the indexer's 18 current rotational position within the cavity 30.

Two spaced-apart apertures 48, 50 are formed in the deck 44, forming a pawl arm 52 with a pawl 38. The pawl arm 52 is nearly as long as the entire top of the deck 44 and is thin enough to flex, yet still provide sufficient spring-bias force to keep the pawl 38 forced against the rosette 32. The pawl 38 is a projection from the pawl arm 52 with a rounded surface configured to engage the detents 34 on the rosette 32, which will be described in more detail below with reference to FIG. 9.

A handle 56 is formed in the deck 44 via depending inner walls 57*a*, 57*b*, 57*c*, 57*d*, 57*e* (collectively 57) arranged in a rectangular shape that generally stretches nearly the diameter of the deck 44. The handle 56 depends down from an interior surface 58 of the indexer 18. The handle 56 provides a structure for the user to grip to turn the indexer 18. The handle 56 could also include a rib, ridge, depressions, or other surface features or texture to enable a secure grip with the user's fingers, to assist in rotating the indexer 18 against the resistance of the pawl 38 and detents 34 as is known in the art and need not be specifically described herein.

Also depending from the deck 44 and/or interior surface 58 and into the interior of the indexer 18 is a semi-circular wall 60 configured to cup the rosette 32, allowing the deck 44 to sit flush against the bottom 26 of the prescription pill vial 10. The wall 60 has a curvature formed from multiple radii, which helps keep the indexer 18 centered on the rosette 32 with little play in the action of the indexer 18. Specifically, a segment of the wall 60 of about 120° has a radius R1 that sits between two outer portions of the wall having radii of R2, where R2>R1. In this embodiment, R1 of 0.3600 inches and R2 of 0.2465 inches have been found to provide excellent stability of the indexer 18 without providing too much resistance to the turning action of the indexer 18. Because the radii R1 and R2 are different the points at which they converge T is raised outwards slightly, forming a point that grips against corresponding detents in the rosette. Combined with opposite pressure from the spring-biased pawl 38, the points T and the pawl 38 form a tripod of sorts against the rosette 32, providing excellent rotational stability to the indexer 18.

Figure 7:
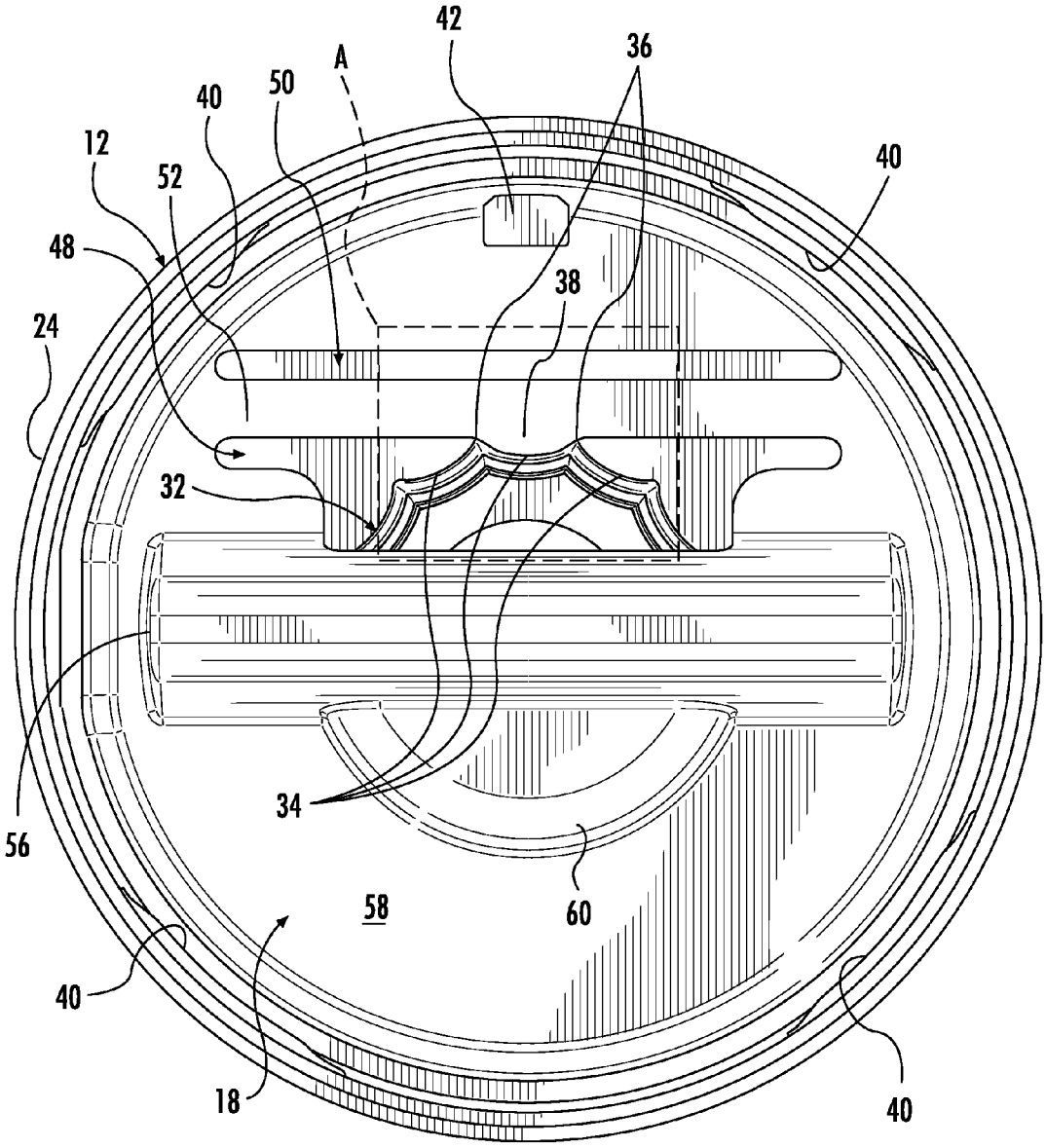
FIG. 7 is a bottom view of the pill vial with the indexer rotated so that the pawl fully engages a detent position on the rosette.
Figure 8:
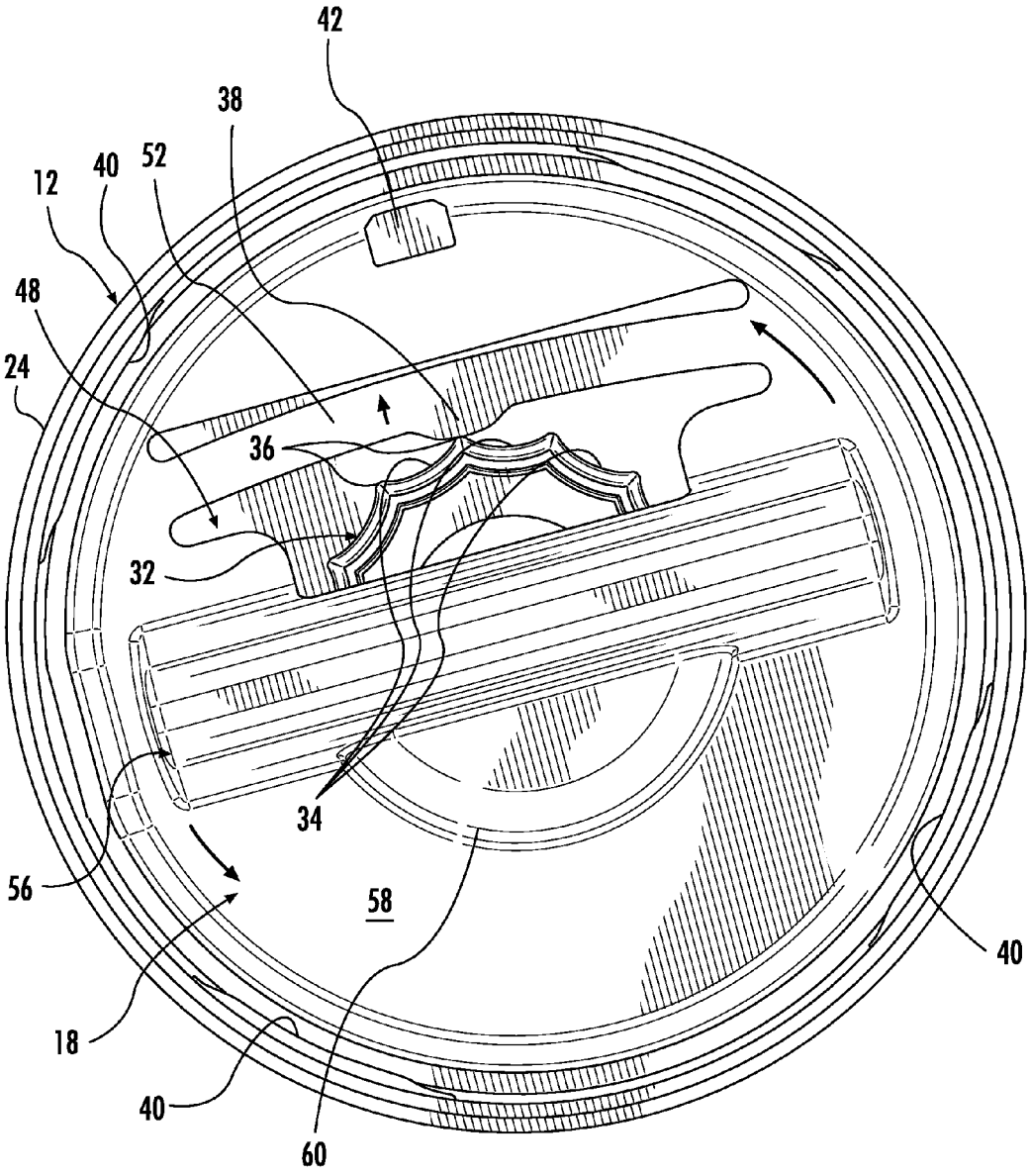
FIG. 8 is a bottom view of the pill vial with ratcheting dosage indexer with the indexer partially rotated, illustrating the flexing of the pawl arm.

Referring to FIGS. 7 and 8, the ratcheting mechanism of the prescription vial and indexer are shown. In FIG. 7, the pawl 38 is shown resting fully within a detent 34 on the rosette 32. As the user turns the indexer 18 via the handle 56, the pawl arm 52 is deflected away from the rosette 32 as the pawl 38 rides up the curved surface of the detent 34 and of the point 36, in order to fall into the next, adjacent detent 34.

Figure 9:
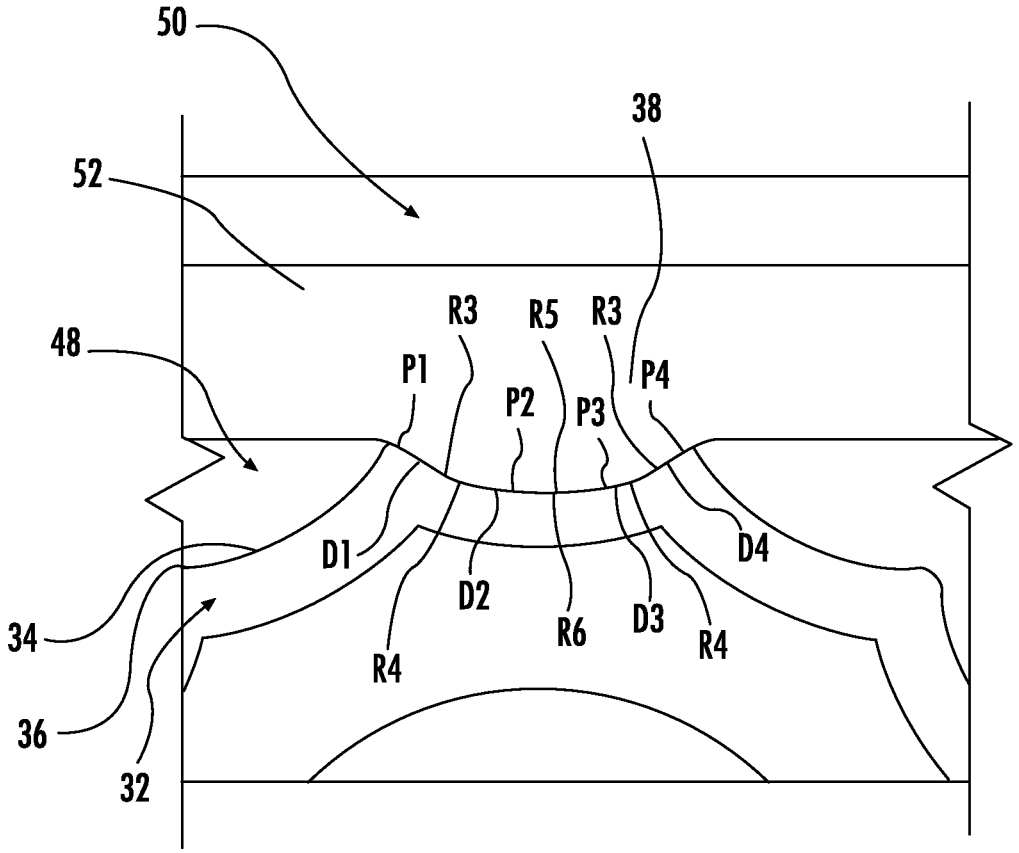
FIG. 9 is a close-up view of Inset A of FIG. 7.

Referring to FIG. 9, a close up view of Inset A of FIG. 7, the convex curved surfaces of the pawl 38 and the detent 34 are shown. Both the pawl 38 and the detent 34 include complimentary concave curved surfaces that are composed of arcs or segments of circles having different radii. Between points P1 and P2 and between points P3 and P4, the curvature of the pawl 38 has a radius of R3. In the preferred embodiment R3=0.081 inches. Between points P2 and P3, the curvature of the pawl has a radius of R5. In a preferred embodiment R5=0.144 inches. On the detent, between points D1 and D2 and between points D3 and D4, the curvature of the detent has a radius of R4. In the preferred embodiment R4=0.078 inches. Between points D2 and D3, the curvature of the pawl has a radius of R6. In a preferred embodiment, R6=0.140 inches. The radii are configured so that R3>R4 and R5>R6, thereby causing a slight gap to form between the pawl 38 and the detent 34. Because the surfaces are not the same, the pawl 38 does not sit perfectly in detent 34, but is cupped by it, which provides enough surface contact with the detent 34 coupled with the spring-bias of the pawl arm 52 that sufficient rotational and lateral stability is provided to the indexer 18. That is, the indexer 18 is not loose inside the cavity 30 and achieves a positive lock in each detent 34 position, yet yields to the user easily when rotated to the next detent 34 position. The fact that the surfaces are curved differently provides for the indexer 18 to be turned more easily as there is less friction to overcome and the pawl 38 does not wobble, teeter-totter or see-saw in the detent 34. Different curvatures may be selected to adjust the action on the indexer, the key being that the overall curvature of the pawl is formed of a larger radius (or radii) than the curvature on the detents.

Therefore, it can be seen that the present invention provides a unique solution to the problem of providing a prescription pill vial with a dosage indexer that includes an indexing mechanism that has a smooth, yet firm, ratcheting action, to provide dosage information to the user.

It would be appreciated by those skilled in the art that various changes and modifications can be made to the illustrated embodiments without departing from the spirit of the present invention. All such modifications and changes are intended to be within the scope of the present invention except as limited by the scope of the appended claims.

What is claimed is:

1. A prescription pill vial, comprising:
   a body having a sidewall and bottom forming an enclosure for prescription medications, the sidewall extending below the bottom forming a cavity beneath the enclosure;
   a rosette on the bottom of the body, the rosette having a plurality of detents thereon; and
   an indexer configured and arranged to fit into the cavity and rotate therewithin, the indexer having a spring-biased pawl that engages the detents on the rosette, limiting the rotation of the indexer to a number of predefined positions corresponding to the detents on the rosette.

2. The prescription pill vial of claim 1, wherein the indicia are attached to the sidewall via a label.

3. The prescription pill vial of claim 2, wherein the label includes prescription information.

4. The prescription pill vial of claim 1, wherein the indicia are integrally formed with the sidewall.

5. The prescription pill vial of claim 1, wherein the rosette includes an odd number of detents.

6. The prescription pill vial of claim 5, wherein the rosette includes thirteen detents.

7. The prescription pill vial of claim 1, wherein the sidewall of the vial is translucent and the index mark on the indexer is visible through the translucent sidewall.

8. The prescription pill vial of claim 1, wherein the index mark is molded on the indexer.

9. The prescription pill vial of claim 8, wherein the index mark is a window on the indexer.

10. The prescription pill vial of claim 1, wherein the indexer further comprises a handle configured and arranged to allow a user to rotate the indexer within the cavity.

11. The prescription pill vial of claim 1, wherein the indexer is recessed entirely inside the cavity.

12. The prescription pill vial of claim ii, further comprising a number of raised shoulders extending from the sidewall into the interior of the cavity, the raised shoulders configured and arranged to retain the indexer within the cavity.

13. The prescription vial of claim 1, wherein the each detent has a curved surface.

14. The prescription pill vial of claim 13, wherein the curved surface on the detent comprises curves formed are from segments of circles having different radii.

15. The prescription pill vial of claim 14, wherein the indexer further comprises a curved wall configured and arranged to contact the rosette.

16. The prescription pill vial of claim 15, wherein the curved wall comprises curves formed are from segments of circles having different radii.

17. The prescription pill vial of claim 1, wherein the pawl has a convex curved surface and each detent has a concave curved surface, wherein the curvature of the convex curved surface is formed from segments of circles having larger radii than the curvature of the concave curved surface on the detent.

18. The prescription pill vial of claim 1, wherein the pawl has a curved surface.

19. The prescription pill vial of claim 1, wherein the curved surface on the pawl comprises curves formed from segments of circles having different radii.

20. The prescription pill vial of claim 1, further comprising a closure configured to couple to the body and enclose the enclosure, forming a moisture proof seal.

* * * * *